US006082980A

United States Patent [19]

Papin

[11] Patent Number: 6,082,980

[45] Date of Patent: Jul. 4, 2000

[54] HELICAL GEAR PUMP

[75] Inventor: Jean-Paul Papin, Creteil, France

[73] Assignee: PCM Pompes, Vanves, France

[21] Appl. No.: 08/972,499

[22] Filed: Nov. 18, 1997

[30] Foreign Application Priority Data

Nov. 21, 1996 [FR] France ..... 96 14227

[51] Int. Cl.[7] ..... F01C 1/10

[52] U.S. Cl. ..... 418/48; 418/179; 418/206.9

[58] Field of Search ..... 418/48, 179, 206.9

[56] References Cited

U.S. PATENT DOCUMENTS

| | | | |
|---|---|---|---|
| 3,622,254 | 11/1971 | LeBlanc, Jr. | 418/179 X |
| 4,008,015 | 2/1977 | McDermott | 418/171 X |
| 4,128,366 | 12/1978 | Sone | 418/179 X |
| 5,772,418 | 6/1998 | Tateno et al. | 418/201.1 X |
| 5,797,734 | 8/1998 | Kizer et al. | 418/179 X |
| 5,876,192 | 3/1999 | Follmer | 418/179 X |

FOREIGN PATENT DOCUMENTS

| | | |
|---|---|---|
| 0297960 | 1/1989 | European Pat. Off. . |
| 2120729 | 12/1983 | United Kingdom . |

*Primary Examiner*—Hoang Nguyen
*Attorney, Agent, or Firm*—Dean W. Russell; Kilpatrick Stockton LLP

[57] ABSTRACT

Gear pump, or Moineau pump, comprising two helical gears one inside the other, the internal helical gear, which is rotary (the rotor) having one tooth fewer than the external helical gear, which is stationary (the stator), characterized in that the rotor and the stator are made of respective materials which have respective coefficients of thermal expansion which lead to respective expansions of the rotor and of the stator which are such that an approximately constant clearance is maintained between the rotor and the stator over a range of ambient temperatures spanning between about 15° C. and about 300° C.

7 Claims, No Drawings

HELICAL GEAR PUMP

The present invention relates to improvements made to gear pumps, or Moineau pumps, which comprise two helical gears one inside the other, the internal helical gear, which is rotary (the rotor) having one tooth fewer than the external helical gear, which is stationary (the stator).

The use of such pumps in the petroleum industry for extracting crude from a well is known. The rotor is made of high-strength steel, plated with chromium in order to be able to withstand abrasion; it is suspended from the end of a string of rods which provides it with rotational drive. The stator is made of moulded elastomer driven into a steel tube; it is suspended from the end of a string of pipes surrounding the aforementioned string of rods. Sealing between rotor and stator is achieved by giving the rotor a diameter that slightly exceeds the minimum diameter of the stator.

Pumps constructed in this way are entirely satisfactory in pumping wells in which the temperature does not exceed about 140° C.

However, in wells in which the temperature exceeds 140° C., pumps built in the traditional way as mentioned above can no longer be used on the one hand, because the elastomer of which the stator is made cannot withstand such temperatures without being damaged, and on the other hand, on account of the fact that the thermal expansion of the elastomer is greater than that of the metal and causes the rotor to be held too tightly in the stator.

The purpose of the invention is essentially to overcome this drawback and to put forward an improved design of Moineau pump capable of operating correctly in a broad range of temperatures which may extend as far as a temperature appreciably higher than 140° C., and which can therefore be used in particular for extracting petroleum from a deep well.

To this end, an improved gear pump or Moineau pump in accordance with the invention is essentially characterized in that the rotor and the stator are made of respective materials which have respective coefficients of thermal expansion which lead to respective expansions of the rotor and of the stator which are such that an approximately constant clearance is maintained between the rotor and the stator over a range of ambient temperatures spanning between about 15° C. and about 300° C.

The improved design according to the invention relies on the fact that thanks to an appropriate choice of materials from which to make the rotor and the stator respectively, the transverse and longitudinal dimensions of the rotor, and the transverse and longitudinal dimensions of the stator cavity both change in the same sense and by the same order of magnitude when the temperature varies (that is to say that the transverse dimension of the rotor and the transverse dimension of the stator cavity increase by more or less the same order of magnitude when the temperature increases and decrease by more or less the same order of magnitude when the temperature decreases).

The pump therefore remains functionally operational in the face of variations in ambient temperature when the rotor and the stator are made of materials which respectively have coefficients of thermal expansion which are such that a predetermined functional clearance between rotor and stator is maintained approximately over a broad range of temperatures extending from about 15° C. (the ambient temperature at which the rotor is assembled with the stator at the workshop) up to an ambient operating temperature of the order of 300° C.

In practical terms, and especially for the more particularly envisaged use of the pump designed in accordance with the invention in the field of extracting petroleum from a deep well, the range of operating temperatures for the pump may be from about 40° C. to about 250° C.

It follows from the foregoing that for the clearance between rotor and stator to be kept approximately constant, the two materials of which the stator and the rotor are respectively made need to have coefficients of thermal expansion of the same order of magnitude, or even coefficients which are relatively close to one another. This means that as the rotor is made of metal so that it has sufficient mechanical strength, it is desirable for the stator too to be made of metal.

This being the case, a preferred choice of materials is given in the table below, in which the coefficient of linear thermal expansion is expressed in mm/°/mm$\times 10^{-6}$ for each:

| | |
|---|---|
| steel Z 30 C 13 | 11.8 |
| steel 316 L | 16.5 |
| cast iron FGS 415 | 11 |
| cast iron FGS Ni 20 | 16 |
| cast iron FGS Ni 30 Cr 1 | 12 |
| bronze UE7 Pb 6 Z 4 | 17 |

The material of which the rotor is made and the material of which the stator is made are chosen to be mechanically compatible as regards problems of friction and wear, and are therefore selected in accordance with the rules known to a person skilled in the art.

In practical terms, the applicant company is of the opinion that at the present time a pair of materials which are preferably appropriate in the context of the invention is given by steel 316 L, whose coefficient of linear thermal expansion is $16.5\times 10^{-6}$ mm/°/mm, of which to make the rotor, and bronze UE7 Pb6 Z4, whose coefficient of linear thermal expansion is $17\times 10^{-6}$ mm/°/mm, of which to make the stator.

The rotor and the stator may be manufactured by any method and any means known to a person skilled in the art. As regards more particularly the stator, use may advantageously be made of one of the following two methods of manufacture:

- the stator may be made by externally compressing a solid lump around a punch that has the definitive profile of the interior shape (cavity) of the stator;
- the stator consists of elements which are obtained individually by flow turning and are joined together by connecting pieces.

As is clear from the foregoing, a favoured (although not exclusive) field in which a gear pump or Moineau pump designed in accordance with the invention can be used is in extracting petroleum from a deep well, with an ambient temperature at the bottom of the well which can vary from about 40° C. to about 250° C.

I claim:

1. Gear pump in the form of a Moineau pump, comprising two helical gears one inside the other, the internal helical gear defining a rotor which is rotary and has one tooth fewer than the external helical gear, which defines a stator and is stationary, the rotor and the stator being made of respective materials which have different coefficients of thermal expansion which lead to respective expansions of the rotor and of the stator which are such that an approximately constant clearance is maintained between the rotor and the stator over a range of ambient temperatures spanning between about 15° C. and about 300° C.

2. Gear pump according to claim 1, in which the material of which the rotor is made and the material of which the stator is made are chosen so that they are mechanically compatible, from steel Z 3 OC 13, steel 316L, cast iron FGS 415, cast iron FGS Ni 20, cast iron FGS Ni 30 Cr1 and bronze UE 7 Pb 6Z4.

3. Gear pump according to claim 2, in which the rotor is made of steel 316L and the stator is made of special bronze UE 7 Pb 6Z4.

4. Gear pump according to claim 1, in which approximately constant clearance between the rotor and the stator is maintained over a temperature range from about 40° C. to about 250° C.

5. Gear pump according to claim 1, in which the stator is made by externally compressing a solid lump around a punch that has the definitive profile of the interior shape of the stator.

6. Gear pump according to claim 1, in which the stator comprises elements which are obtained individually by flow turning and are joined together by connecting pieces.

7. Use of a gear pump according to claim 1 for extracting petroleum products from a deep well.

* * * * *